US006652375B2

(12) United States Patent
Donnelly

(10) Patent No.: US 6,652,375 B2
(45) Date of Patent: Nov. 25, 2003

(54) AIR-CONDITIONING REGISTER AND BOOT ASSEMBLY

(75) Inventor: William James Donnelly, Ivanhoe (AU)

(73) Assignee: Talana Investments Limited, Tortola (VG)

( * ) Notice: Subject to any disclaimer, the term of this patent is extended or adjusted under 35 U.S.C. 154(b) by 26 days.

(21) Appl. No.: 09/994,109

(22) Filed: Nov. 26, 2001

(65) Prior Publication Data

US 2003/0100258 A1 May 29, 2003

(51) Int. Cl.[7] ..... F24F 7/00
(52) U.S. Cl. ..... 454/330; 454/331; 454/289
(58) Field of Search ..... 454/330, 331, 454/289, 290; 49/51, 52; 55/493

(56) References Cited

U.S. PATENT DOCUMENTS 380,145 A * 3/1888 Springer ..... 454/331
465,561 A * 12/1891 Hood ..... 454/330
637,519 A * 11/1899 Mertins ..... 454/289
671,593 A * 4/1901 Harper ..... 454/330
672,765 A * 4/1901 Hart ..... 454/331
770,326 A * 9/1904 Slater ..... 454/290
1,080,512 A * 12/1913 Goodwin ..... 454/331
2,679,796 A * 6/1954 Froelich et al. ..... 454/331
2,722,170 A * 11/1955 Broberg ..... 454/332
3,366,031 A * 1/1968 Hedrick et al. ..... 454/332
4,171,211 A * 10/1979 Carter ..... 55/493
4,274,330 A * 6/1981 Witten et al. ..... 160/131
5,716,270 A * 2/1998 Chambers ..... 454/309
6,192,640 B1 * 2/2001 Snyder ..... 220/3.5
6,227,962 B1 * 5/2001 Orendorff ..... 454/289

* cited by examiner

*Primary Examiner*—Derek Boles
(74) *Attorney, Agent, or Firm*—Greer, Burns & Crain, Ltd.

(57) ABSTRACT

A register and boot assembly for a ducted heating or air conditioning assembly is provided which has a boot member, a register mounting member detachably connected to the boot member and a register face member mounted on the mounting member to cover the front face thereof. The assembly may be simply and conveniently installed in an opening in a floor, wall or ceiling by flexible securing clips mounted on upper edges of side or end walls of the mounting member. The securing clips have gripping formations which engage with similar formations on the face member to assist in retaining the face member to the mounting member.

30 Claims, 3 Drawing Sheets

AIR-CONDITIONING REGISTER AND BOOT ASSEMBLY

This invention relates to ducted heating and air-conditioning systems and is particularly concerned with providing an improved register and boot assembly for use in such systems.

In ducted central heating or air-conditioning systems, heated or conditioned air is delivered to various room or other spaces within a building via a piped or ducted network from a centrally located plant. In such systems, air vents are often located in the floors of the rooms or spaces to which conditioned air is to be supplied. However, air vents may equally be provided in the walls or ceiling of the room or space.

Generally in the installation of ducted heating or air-conditioning systems, the entry point of conditioned air is provided via two components of an air delivery system: a boot; and a register.

Historically, the boot is a component having an air inlet portion and a mouth portion defining an air outlet, the shape of which corresponds to a hole provided in the floor, wall or ceiling of the room to which heated or conditioned air is to be supplied. The air inlet portion is designed to be attached to the incoming duct carrying the conditioned air.

The second component or "register" is adapted to fit over the mouth portion of the boot and is usually designed to diffuse the incoming air to the best advantage for the room or space. Usually, louvres are formed in the face of the register. The register may also include devices behind the face to regulate and/or close off the air supply.

In Australia over the past ten years or so, moulded plastic diffusers suitable only for ceiling applications have become popular and, in some cases, incorporate within their construction both the inlet connection for the ducting and the outlet register or "face" to the conditioned space. However, all known floor entry points consist of an entry boot and a floor register. In the United States of America, Canada and other countries where ducted heating or air-conditioning is popular, most entry points for conditioned air delivery have both a register and a boot which can be relatively expensive to manufacture and time consuming to install.

It is therefore desirable to provide an improved register and boot assembly for a ducted heating or air-conditioning system which is relatively inexpensive to produce and relatively simple to install.

According to one aspect of the invention, there is provided a register and boot assembly for a ducted heating or air-conditioning system the assembly comprising:

- a boot member having a tubular air inlet portion and a mouth portion defining an air outlet;
- a register mounting member adapted to be connected to the boot member and having closed side walls and open front and rear faces; and
- a register face member adapted to be mounted on the mounting member so as to cover the open, front face of the mounting portion.

The register mounting member is preferably detachably connected to the boot member. Preferably, the boot member has a flange surrounding the air outlet of the mouth portion and the rear part of the register mounting member is adapted to engage with the flange to attach the register mounting member to the boot member.

In a particularly preferred embodiment, the register mounting member and flange are substantially rectangular in shape and the mounting member has channel formations on opposite sides engageable with corresponding sides of the flange of the boot member so that the mounting member can slide onto the boot member to be retained thereon.

Whilst the boot member, register mounting member and register face member are preferably rectangular in shape, it will be appreciated that they could be of other shapes, such as circular, hexagonal, etc.

The register and boot assembly preferably includes an air flow control device. In a preferred embodiment, the air flow control device includes a baffle rotatably mounted within the register mounting member. A control member may be conveniently provided to operate the air flow control device.

The control member is preferably in the form of a slide member which is mounted for slidable movement relative to the register face member. The slide member preferably has a portion engageable with a co-operating part of the air flow control device in such a manner that slidable movement of the slide member causes rotational movement of the air flow control device to regulate and/or close the air flow through the register and boot assembly.

Preferably, the register face member has a louvred face portion in the form of a grille of transverse bars with openings therebetween. The register face member preferably also has a transverse slot and the slide member preferably has one or more legs which extend through the slot and engage with a pintle which is offset from the axis of rotation of the rotatable baffle. An adjustable stop may be provided for restricting sliding movement of the control slide and therefore rotational movement of the baffle to provide volume air control.

The register mounting member preferably has resilient securing clips provided at opposite locations on its side wall and/or end walls for mounting the assembly in a complementary sized aperture in a floor, wall or ceiling of the room or other space to which heated or conditioned air is to be supplied. The securing clips preferably have flexible portions extending outwardly from the register mounting portion and which are adapted to flex inwardly when the mounting portion is inserted into the aperture in the floor, wall or ceiling. After insertion, the securing clips flex outwardly to engage with the sides of the aperture to retain the register mounting portion in position in the aperture.

The register face member preferably has a mounting portion of external dimensions similar to the internal dimensions of the mounting member so that the mounting portion can fit snugly within the mounting member. Preferably, areas of the external surface of the mounting portion have gripping formations, such as ridges or corrugations, for engagement with complementary gripping formations on the side and/or end walls of the mounting member.

In one particularly preferred embodiment, the gripping formations are provided on internal surfaces of the securing clips which are arranged to clip over the side walls and/or end walls of the mounting member.

In a further advantageous feature of the invention, the register and boot assembly is preferably supplied for installation with a removable membrane which covers the open front face of the mounting member or the mouth of the boot member. Such a membrane is arranged to protect the entry of dust, debris and moisture into the mounting member and/or the boot when the mounting member and/or boot are placed in position in a floor or wall aperture some time prior to subsequent assembly of the mounting member and/or register.

According to another aspect of the invention there is provided a register and boot assembly for a ducted heating or air-conditioning system, the assembly including a boot having a tubular air inlet portion and a mouth portion defining an air outlet, and a register adapted to be attached to the boot member, the register including a front face with at least one opening, wherein a removable membrane is provided which covers the front face and/or the mouth portion of the boot to prevent the entry of dust, debris and moisture into the boot prior to attachment of the register.

Preferred embodiments of the invention will now be described, by way of example only with reference to the accompany drawings, in which.

Figure 1:
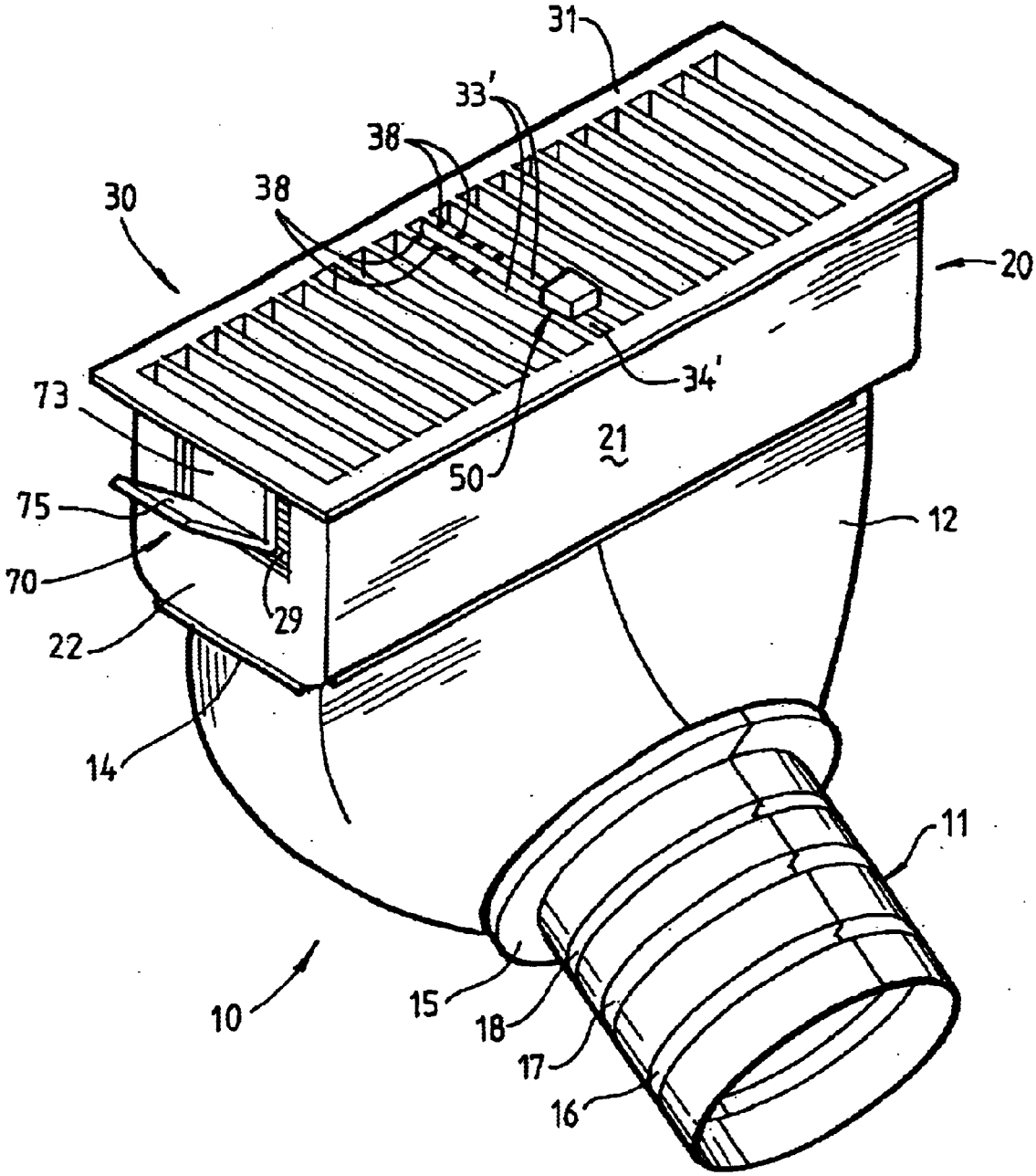
FIG. 1 is a perspective view of a duct joiner assembly in accordance with the invention.

The duct joiner assembly shown in the drawings comprises a boot member 10, a register mounting member 20 and a register face member 30.

Figure 2:
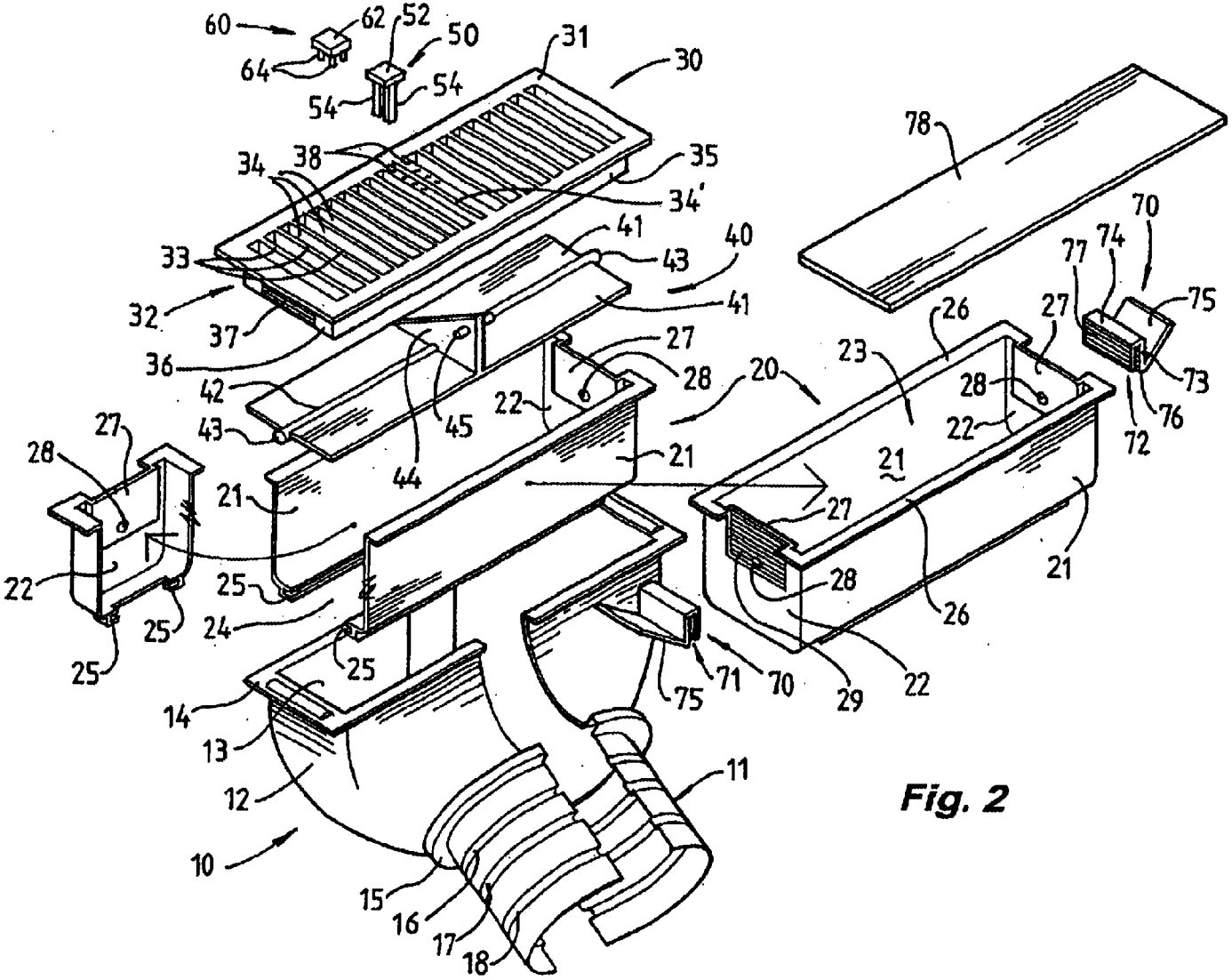
FIG. 2 is an exploded perspective view of the components of the assembly of FIG. 1.

The boot member 10 has a tubular air inlet portion 11 and an air outlet portion 12, the upper end of which as shown in FIG. 2 defines an open mouth 13. The air outlet portion 12 is of curved shape having a rectangular flange 14 around the mouth 13 and tapering down to a lower flange 15 where the tubular air inlet portion 11 meets the air outlet portion 12. Thus, the air inlet portion 11 extends at an acute angle to the plane of the mouth 13. In other applications, the air inlet portion may extend perpendicularly to the plane of the mouth. The tubular air inlet portion 11 is provided with grooves 16, 17 and 18 in its cylindrical outer surface which may be provided with retaining projections formed integrally or fitted in the grooves 16, 18 and a sealing ring for joining and sealing the tubular air inlet portion to an end of a cylindrical air supply duct of a ducted heating or air conditioning system. The projections and sealing ring provided in the grooves 16, 17 and 18 may be of similar form to those described in our Australian patent application No. 35341/00 entitled "Improved Duct Joiner and Method of Manufacture", the contents of which are incorporated herein by reference.

The boot member is preferably formed in two halves of injection moulded plastics material, and the two halves of the boot member may be attached together in similar manner to the method described in our co-pending Australian patent application entitled "Improved Duct Joiner and Method of Manufacture". Alternatively, the boot member may be formed in one piece.

The register mounting member 20 is also of rectangular form having opposed side walls 21 opposed end walls 22 an open front face 23 and an open rear face 24.

Channel formations 25 are provided along each side of the rear face 24, the channel formations being adapted to engage with the sides of the flange 14 around the mouth 13 of the boot member 10. A flange 26 surrounds the open front face 23 of the register mounting member 20. The end walls 22 of the register mounting member 20 have indented portions 27 provided with gripping formations 29 on their outer surfaces which assist in the mounting of securing clips 70 on the upper ends of the end walls 22. A round hole 28 is provided in each indented portion 27 for rotatably receiving the ends of a spindle 42 of an air flow control device or baffle 40 of the register and boot assembly.

The rectangular dimensions of the side and end walls of register mounting member 20 are greater than the dimensions of the mouth portion 12 of the boot member. This provides an advantage in installation of the boot and register assembly as will be described later. The register face member 30 has a louvred front face portion 31 and a lower mounting portion 32. The front face portion 31 is in the form of a generally rectangular grille formed by transversely extending alternating bars 33 and slots 34. The mounting portion 32 has short side walls 35 and end walls 36 extending rearwardly from the front face plate 31. The end walls 36 of the register face member 30 have gripping formations 37 on their outer surfaces which are of similar form to the gripping formations 29 on the outer surfaces of the register mounting member 20.

The air flow control device 40 comprises a generally rectangular baffle which is adapted to be mounted within the register mounting member below the register face member 30 in the assembled register and boot assembly. The baffle 40 has a pair of co-planar wings 41 extending outwardly from opposite sides of a central cylindrical spindle 42. The end parts 43 of the spindle 42 extend beyond the ends of the wings and are adapted to be received in the holes 28 in the end walls 22 of the register mounting member 20 to mount the baffle 40 within the register mounting member 20. The upper surface of the baffle 40 as shown in FIG. 2 has a triangular part 44 on which a cylindrical pintle 45 is provided. The longitudinal axis of the pintle 45 is parallel to but offset from the longitudinal axis of the cylindrical spindle 42.

When mounted in the register mounting member, the baffle 40 is rotatable about the longitudinal axis of the spindle 42. Rotational movement of the baffle 40 is controlled by a control member or slide 50. The slide 50 has an upper square plate portion 52 and a pair of legs 54 depending from the slide 50. In use, the legs of the slide 50 are inserted into a central slot 34 of the face plate 31 and engage over the pintle 45 of the baffle 40, so that when the slide is moved laterally in the central slot 34, the baffle 40 rotates about the longitudinal axis of the spindle 42 to open, close or regulate the air flow through the register and boot assembly.

The register and boot assembly is also provided with an adjustable stop 60 to limit the sliding movement of the control member or slide 50. The adjustable stop comprises a small square plate 62 with four pegs 64 depending downwardly from the plate 62. In use, the pegs 64 are received in complementary holes 38 provided in the bars 33' of the grille on either side of the central slot 34'. As shown in FIGS. 1 and 2, eight holes 38 are provided in the bars 33 so that the position of the stop 60 can be adjusted as required. It will, however be appreciated that a different number of holes may be provided to vary the number of positions for the stop to suit different applications. In an alternative embodiment, the holes may be replaced by recesses or indentations.

The register and boot assembly is adapted to be mounted in a rectangular opening in the floor of a room or space to which heated or conditioned air is to be supplied by means of the securing clips 70 which are adapted to be mounted on the upper edges of the end walls 22 of the register mounting member 20. Each securing clip 70 has an inverted U-shaped portion 71 formed by a first limb 72, a second limb 73 and a bridge section 74, and a flexible outward portion 75 extends outwardly and upwardly from the lower end of the second limb 73. The U-shaped portions 71 engage over the upper edges of the indented portions 27 of the end walls 22 and the inner surface of the second limb 73 is provided with gripping formations 76 which engage with the gripping formations 29 on the outer surfaces of the indented portions 27 of the end walls 22. The outer surfaces of the first limbs 72 of the securing clips 70 also have gripping formations 77 provided thereon. The gripping formations 77 are adapted to engage with the gripping formations 37 on the outer surfaces of the ends 36 of the mounting portion 32 of the face member to assist in retaining the face member 30 to the register mounting member 20 in the complete register and boot assembly. Preferably, the gripping formations 29, 76, 37 and 77 are in the form of horizontally extending ridges or corrugations which provide resistance against separation of the relevant parts in the complete register and boot assembly.

Figure 3:
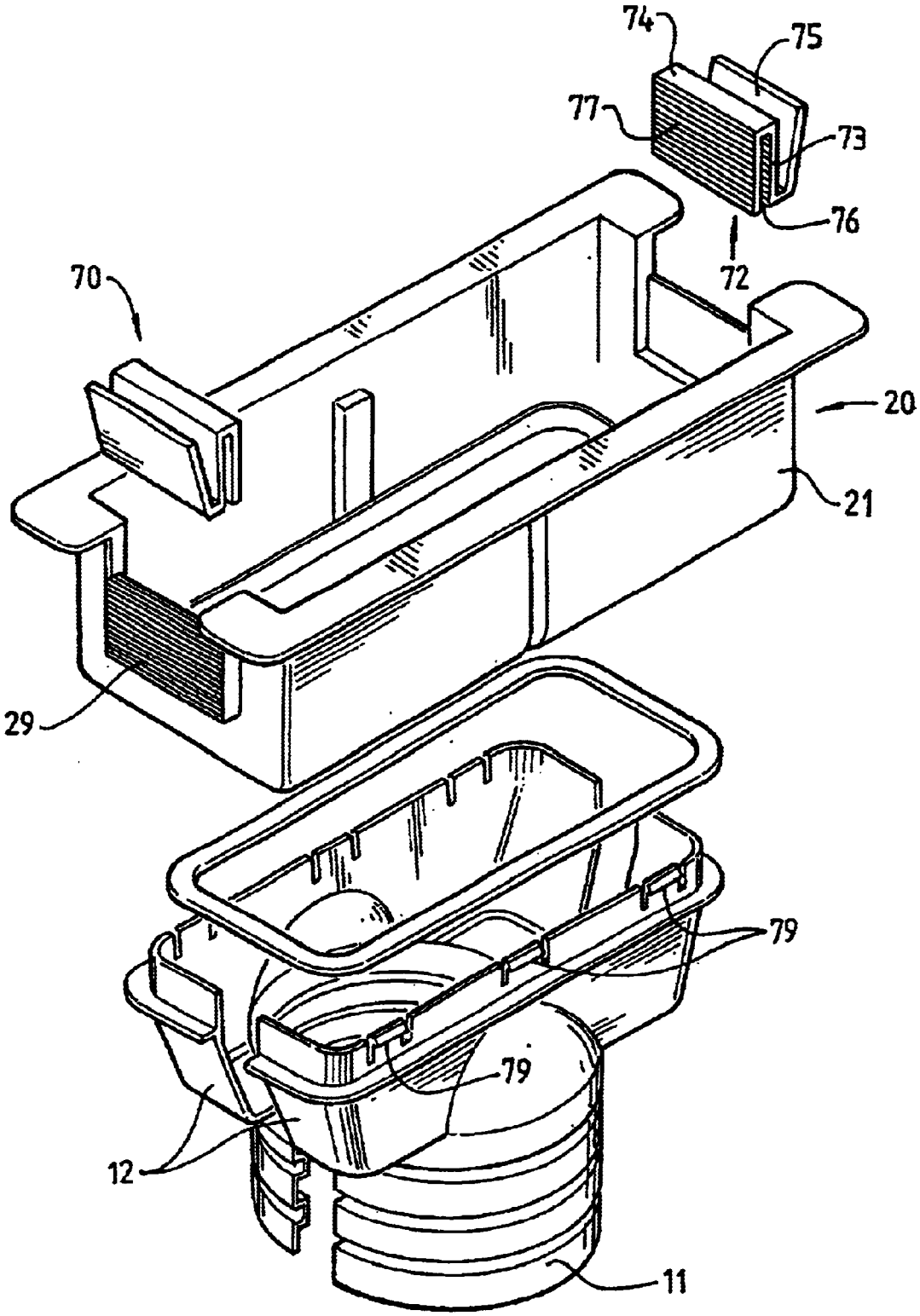
FIG. 3 is an exploded perspective view of components of a modified duct joiner assembly.

It will be appreciated from the foregoing description that the register and boot assembly is simple to assemble and install in a rectangular aperture in the floor of a room with the register mounting member 20 being slidably mounted on the boot member 10 by means of the channel formations 25 which can slide onto the flange 14 of the boot member 10. An alternative means of assembly as shown in FIG. 3 is to mould a series of restraining flexible clips 79 to the leading edge of the mouth portion 12 of the boot 10 for attachment to the register mounting member 20. This eliminates the need for the flange 14 and channel formation 25. It will, however, be appreciated that other means of joining the boot 10 to the register mounting member 20 may be provided. Also, the mounting portion 32 of the register face member 30 can be easily inserted into the register mounting member 20 and retained therein by the gripping formations 37 and 77. The securing clips 70 are also retained securely on the upper edges of the indented portions 27 of the end walls 22 by the gripping formations 29 and 76. Further, the flexible outwardly extending portions 75 of the securing clips provide for a simple and quick installation of the assembly within an aperture of the floor of a room or space to be supplied with heated or conditioned air via the register and boot assembly.

Each of the components of the register and boot assembly described above may be conveniently formed from injection moulded plastics material to provide a low cost register and boot assembly, although it will be appreciated that at least some of the components of the register and boot assembly may be formed from other materials.

A further advantage in installation of the register and boot assembly described above, particularly with low floors, is that with the boot member 10 having a mouth portion 12 of smaller dimensions than the register mounting member 20, the boot member 10 can first be joined to the end of a duct and located below the floor. Then, when it is required to attach the register, the boot member 10 can be raised up through the floor aperture to enable the register mounting member to be attached thereto. With low floors, where space is limited it is also possible for the boot member to be attached to the end of ducting at a different location below the floor where more space is available and then the boot member can be fed under the floor with the ducting to the location of the floor aperture, raised through the aperture and attached to the register mounting member. The assembly can then be lowered into position with the clips at the ends of the register mounting assembly engaging with the sides of the floor aperture.

In the installation of ducted heating and air-conditioning systems in new buildings, often the boot of a boot and register assembly is installed in an aperture in the floor of a room or space some time (often days) before the register is connected to the boot. In this case, dust, debris and water can fall into the boot and ducts of the ducted system, which is undesirable. In order to overcome this problem, a removable membrane, preferably in the form of a thin film of plastics material 78 is attached to the upper surface of the flange 14 of the boot member 10. For this purpose, the membrane 78 may have a self-adhesive margin around its periphery. Then, if the boot member 10 is installed in position some time prior to attachment of the register mounting member 20 and register face member 30, the membrane 78 will prevent dust, debris and water from falling into the boot member 10 and entering the duct of the heating or air-conditioning system. The membrane can then be removed just before attachment of the register mounting member and face member.

In a modified embodiment, the removable membrane 78 may be attached to the upper surface of the flange 26 of the register mounting member 20 to cover the open front a face 23 of the mounting member 20. In this case the membrane 78 can prevent the entry of dust, debris and moisture into the mounting member 20 and boot member 10 when they are installed in position some time prior to attachment of the baffle 40 and/or register face member 30.

It will also be appreciated that various modifications and alterations may be made to the register and boot assembly described above without departing from the scope and spirit of the present invention For instance, the register and boot assembly may be mounted in the wall or ceiling of a room or space to be supplied with heated or conditioned air, and the shape of the various components of the register and boot assembly may be varied for different applications.

What is claimed is:

1. A register and boot assembly for a ducted heating or air-conditioning system, the assembly comprising:

a boot member having a tubular air inlet portion and a mouth portion defining an air outlet;

a register mounting member connectable to the boot member and having closed side walls and open front and rear faces;

a register face member mountable on the mounting member so as to cover the open, front face of the mounting member;

said register mounting member is detachably connected to the boot member;

the boot member has a flange surrounding the air outlet of the mouth portion and the rear part of the register mounting member is adapted to engage with the flange to attach the register mounting member to the boot member;

the register mounting member and flange are substantially rectangular in shape and the mounting member has channel formations on opposite sides engageable with corresponding sides of the flange of the boot member so that the mounting member can slide onto the boot member to be retained thereon.

2. A register and boot assembly according to claim 1 and further comprising an air flow control device.

3. A register and boot assembly according to claim 2 wherein the air flow control device includes a baffle rotatably mounted within the register mounting member.

4. A register and boot assembly according to claim 3 wherein a control member is provided to operate the air flow control device.

5. A register and boot assembly according to claim 4 wherein the control member comprises a slide member mounted for slidable movement relative to the register face member.

6. A register and boot assembly according to claim 5 wherein the slide member has a portion engageable with a co-operating part of the air flow control device in such a manner that slidable movement of the slide member causes rotational movement of the air flow control device to regulate and/or close the air flow through the register and boot assembly.

7. A register and boot assembly according to claim 1 wherein the register face member has a louvred face portion in the form of a grille of transverse bars with openings therebetween.

8. A register and boot assembly according to claim 6 wherein the register face member has a transverse slot, and the slide member has one or more legs which extend through the slot and engage with a bar or pintle which is offset from the axis of rotation of the rotatable baffle.

9. A register and boot assembly according to claim 8 wherein an adjustable stop is provided for restricting sliding movement of the control slide and therefore rotational movement of the baffle.

10. A register and boot assembly according to claim 9 wherein the adjustable stop comprises a stop member with downwardly depending pegs received in complementary holes or recesses in the register face member.

11. A register and boot assembly according to claim 10 wherein the number of holes or recesses exceeds the number of pegs on the adjustable stop.

12. A register and boot assembly according to claim 1 wherein the register mounting member has resilient securing clips provided at opposite locations on its side wall and/or end walls for mounting the assembly in a complementary sized aperture in a floor, wall or ceiling of the room or other space to which heated or conditioned air is to be supplied.

13. A register and boot assembly according to claim 12 wherein the securing clips have flexible portions extending outwardly from the register mounting member which flex inwardly when the mounting member is inserted into the aperture in the floor, wall or ceiling and which, after insertion flex outwardly to engage with the sides of the aperture to retain the register mounting member in position in the aperture.

14. A register and boot assembly according to claim 12 wherein the register face member has a mounting portion of external dimensions similar to the internal dimensions of the mounting member so that the mounting portion can fit snugly within the mounting member.

15. A register and boot assembly according to claim 14 wherein areas of the external surface of the mounting portion have gripping formations, such as ridges or corrugations, for engagement with complementary gripping formations on side and/or end walls of the mounting member.

16. A register and boot assembly according to claim 15 wherein the gripping formations are provided on inwardly facing surfaces of the securing clips which are arranged to clip over the side walls and/or end walls of the mounting member.

17. A register and boot assembly according to claim 1 wherein the register and boot assembly is supplied for installation with a removable membrane which covers the open front face of the mounting member or the mouth of the boot member.

18. A register and boot assembly according to claim 17 wherein the removable membrane is affixed to the face of the mounting member.

19. A register and boot assembly according to claim 17 wherein the removable membrane is affixed to the mouth portion of the boot member.

20. A register and boot assembly according to claim 1 wherein a series of restraining flexible clips are provided on the mouth portion of the boot member which are engageable with the register mounting member to attach the register mounting member to the boot member.

21. A register and boot assembly for a ducted heating or air conditioning system, the assembly comprising:

a boot member having a tubular air inlet portion and a mouth portion defining an air outlet;

a register mounting member connectable to the boot member and having closed side walls and open front and rear faces;

a register face member mountable on the mounting member so as to cover the open front face of the mounting portion, and having a louvered face portion in the form of a grille of transverse bars with openings therebetween and a transverse slot;

a baffle rotatably mounted within the register mounting member for controlling the flow of air through the register mounting member;

a slide member for controlling movement of the baffle and having one or more legs extending through the slot and engageable with a bar or pintle which is offset from the axis of rotation of the rotatable baffle; and an adjustable stop for restricting sliding movement of the control slide and therefore rotational movement of the baffle.

22. A register and boot assembly according to claim 21 wherein the adjustable stop comprises a stop member with downwardly depending pegs received in complementary holes or recesses in the register face member.

23. A register and boot assembly according to claim 22 wherein the number of holes or recesses exceeds the number of pegs on the adjustable stop.

24. A register and boot assembly for a ducted heating or air-conditioning system, the assembly comprising:

a boot member having a tubular air inlet portion and a mouth portion defining an air outlet;

a register mounting member connectable to the boot member and having closed side walls and end walls and open front and rear faces; and a register face member having a mounting portion mountable on the mounting member so as to cover the open, front face of the mounting member, the mounting portion having external dimensions similar to the internal dimensions of the mounting member so that the mounting portion can fit snugly within the mounting member, wherein areas of the external surface of the mounting portion have gripping formations for engagement with complementary gripping formations on side and/or end walls of the register mounting member;

the register mounting member has resilient securing clips provided at opposite locations on its side wall and/or end walls for mounting the assembly in a complementary sized aperture in a floor, wall or ceiling of the room or other space to which heated or conditioned air is to be supplied.

25. A register and boot assembly according to claim 24 wherein the register mounting member has resilient securing clips provided at opposite locations on its side wall and/or end walls for mounting the assembly in a complementary sized aperture in a floor, wall or ceiling of the room or other space to which heated or conditioned air is to be supplied.

26. A register and boot assembly according to claim 24 wherein the securing clips have flexible portions extending outwardly from the register mounting member which are adapted to flex inwardly when the mounting member is inserted into the aperture in the floor, wall or ceiling and which, after insertion flex outwardly to engage with the sides of the aperture to retain the register mounting member in position to the aperture.

27. A register and boot assembly according to claim 26 wherein the gripping formations on the side and/or end walls are provided on inwardly facing surfaces of the securing clips which are arranged to clip over the side walls and/or end walls of the mounting member.

28. A register and boot assembly for a ducted heating or air conditioning system, the assembly comprising:

a boot member having a tubular air inlet portion and a mouth portion defining an air outlet;

a register mounting member connectable to the boot member and having closed side walls and end walls and open front and rear faces;

a register face member mountable on the mounting member so as to cover the open, front face of the mounting portion;

the register mounting member has resilient securing clips provided at opposite locations on its side walls and/or end walls for mounting the assembly in a complementary sized aperture in a floor, wall or ceiling of the room or other space to which heated or conditioned air is to be supplied;

the register face member has a louvered face portion in the form of a grille of transverse bars with openings therebetween;

the register face member has a transverse slot, and the slide member has one or more legs which extend through the slot and engage with a bar or pintle which is offset from the axis of rotation of the rotatable baffle; and an adjustable stop is provided for restricting sliding movement of the control slide and therefore rotational movement of the baffle.

29. A register or boot assembly according to claim 28 wherein the resilient securing clips have U-shaped attachment portions which engage over the edges of the side or end walls of the register mounting member, and an inner surface of the U-shaped attachment portion is provided with gripping formations which engage with complementary gripping formations on the side or end walls of the register mounting member.

30. A register or boot assembly according to claim 29 wherein the resilient securing clips have flexible portions extending outwardly from the attachment portions which flex inwardly when the mounting member is inserted into the aperture in the floor, wall or ceiling and which, after insertion, flex outwardly to engage with the sides of the aperture to retain the register mounting member in position in the aperture.

* * * * *